US005934667A

United States Patent [19]

Miki

[11] Patent Number: 5,934,667

[45] Date of Patent: Aug. 10, 1999

[54] PAPER FEEDING MECHANISM TO FEED INDIVIDUAL SHEETS FROM A TRAY OR CASSETTE

[75] Inventor: Katsuhiko Miki, Ichikawa, Japan

[73] Assignee: Ricoh Company, Ltd., Tokyo, Japan

[21] Appl. No.: 08/782,943

[22] Filed: Jan. 13, 1997

[30] Foreign Application Priority Data

Jan. 12, 1996 [JP] Japan ..... 8-004172
Feb. 5, 1996 [JP] Japan ..... 8-019146

[51] Int. Cl.[6] ..... B65H 1/18

[52] U.S. Cl. ..... 271/152; 271/160; 271/169; 271/170; 271/127

[58] Field of Search ..... 271/22, 25, 119, 271/127, 152, 153, 160, 169, 170, 171

[56] References Cited

U.S. PATENT DOCUMENTS 5,508,810 4/1996 Sato .

FOREIGN PATENT DOCUMENTS 2-88943 12/1963 Japan .
53-113533 10/1978 Japan .
0138026 5/1990 Japan ..... 271/160
4-125230 4/1992 Japan .
404292345 10/1992 Japan ..... 271/170
404341436 11/1992 Japan ..... 271/170

*Primary Examiner*—H. Grant Skaggs
*Attorney, Agent, or Firm*—Oblon, Spivak, McClelland, Maier & Neustadt, P.C.

[57] ABSTRACT

A paper feeding mechanism and method which reliably feeds individual sheets stacked on a base plate. When a full stack of sheets resides on the base plate, as the sheets are removed one-by-one from the top of the stack, the base plate pivots about an end of the base plate. After the base plate pivots to a predetermined level, a pin passing through an oblong hole in a side support connected to the base plate contacts an end of the oblong hole and changes the pivot position of the base plate to the position of the pin. Also, a separating claw is raised as the sheets are removed from the stack. As the sheets from the stack are removed, the base plate supporting the sheets is raised. The raising of the base plate causes the rotation of a cam member. As the cam member rotates, the changing cam surface which contacts a separating member connected to the separating claw causes the separating claw to be raised.

25 Claims, 6 Drawing Sheets

PAPER FEEDING MECHANISM TO FEED INDIVIDUAL SHEETS FROM A TRAY OR CASSETTE

BACKGROUND OF THE INVENTION

1. Field of the Invention

The present invention relates to a device and method for feeding sheets of paper from a paper tray or cassette. The invention is more particularly related to a paper feeding device and method which changes a pivot point of a base plate supporting a stack of sheets. The invention is also related to a paper feeding device and method in which the position of a separating claw or corner separator is set based on a position of a base plate supporting a stack of sheets.

2. Discussion of the Background

Conventional image forming apparatuses such as printers, facsimile machines, and copiers feed individual sheets from a stack of sheets. However, a problem with conventional feeding mechanisms is that paper jams sometimes occur due to deficiencies inherent to the design of the paper feeding mechanism.

FIG. 1 illustrates a conventional paper tray 1 having a base plate 2 which has thereon a stack of sheets of paper P. The base plate 2 pivots at a pin 5 which passes through a circular hole 4 of a side support 3 connected to the base plate 2. The top sheet from the stack of sheets P is removed by a feed roller 8. A spring 6 is used to raise the base plate 2 in order to keep the stack of sheets P against the feed roller 8.

The base plate 2 has as its pivot point the pin 5. This means that as the base plate 2 is raised from a lowered position as illustrated in FIG. 1, the end of the base plate 2 disposed away from the side support 3 moves closer to the side of the paper tray 1. As the base plate 2 moves upwardly, the lower sheets on the base plate 2 may also contact the side of the paper tray 1. From this raising of the base plate 2, the lower sheets of the stack of sheets P may experience a force illustrated as F in FIG. 1 which moves the sheets away from the side of the paper tray 1. The present inventors have realized that when there are a large number of sheets in the stack P, the weight of the large number of sheets may prevent the lower sheets from sliding due to the force F. If the lower sheets cannot slide, it is possible that the base plate 2 may not be properly raised by the force of the spring 6 and therefore, not properly contact the feed roller 8.

In another conventional paper feeding mechanism as illustrated in FIG. 2, a separating claw 9 is utilized in accordance with the known and conventional corner separation method. In FIG. 2, the separating claw or corner separator 9 can move up and down to a certain extent which is limited by the protrusion 9*a* which resides between two fixed members 10*a* and 10*b* which may be implemented as part of the side of the paper tray 1. In FIG. 2, when the paper tray is completely full, the top of the stack of sheets is at level Y, and when the stack of sheets is nearly exhausted and there remain only a few sheets in the tray, the top sheet will have a position as indicated by Z.

When a sheet is fed when the base plate 2 has a complete stack of sheets thereon, the rotation of the semicircular feed roller 8 about the shaft 8*a* causes the stack of sheets to be pushed downwardly so that the top sheet of the stack of sheets moves to the position Y', as illustrated in FIG. 3. The separating claw 9 should remain in contact with the top sheet as the stack of sheets is pushed downwardly and therefore, needs to be lowered by a distance designated by a.

When the supply of sheets is nearly used up, as illustrated in FIG. 4, the base plate 2 is angled upwardly toward the corner separator 9. The angling of the base plate 2 results in the lowering of a point of contact of the top sheet and the feed roller 8 when the top sheet is not contacting the feed roller 8. When the feed roller 8 rotates, the top sheet and the base plate 2 are lowered by a distance b which is smaller than the distance a illustrated in FIG. 3. Because the distance or length a is different from the distance or length b, the amount of travel of the separating claw 9 is different. This may result in a different pressure on the sheet between the separating claw 9 and the base plate, depending on the number of sheets in the stack. This difference in pressure along with the different distances the separating claw 9 must travel can make the implementation of the proper pressure of the corner separator difficult, and may cause paper jams.

SUMMARY OF THE INVENTION

Accordingly, it is an object of the invention to provide a paper feeding mechanism which reliably feeds individual sheets of paper from a paper tray.

It is a further object of the invention to overcome the problem of lower sheets of paper in a stack from experiencing a large force away from the front of a paper tray or cassette by changing the pivot position of the base plate and the paper thereon.

It is a further object of the invention to provide a paper feeding mechanism and system which uses a separating claw which has its position adjusted based on a position of the base plate on which pages rest.

These and other objects are accomplished by a device for feeding papers implemented as a paper tray or cassette. The paper tray has a base plate which supports sheets. A side support is connected to a base plate and has an oblong hole. There is a circular support pin passing through the oblong hole. When the end of the base plate from which the sheets are fed is lower than a first level, the base plate pivots at an end opposite to the feed end. As the stack of sheets is reduced and the base plate is raised in order to keep the sheets pressed against the feed roller, the support pin passing through the oblong hole reaches an end of the oblong hole and therefore, the support pin becomes the pivot point for the base plate.

During operation of this embodiment, the sheets are removed from the top of the stack which has a first pivot point. As the sheets are removed, the base plate pivots at the first pivot point. After a sufficient number of sheets are used up, the pivot point of the base plate changes to a second pivot point. As the remaining sheets are removed from the base plate, the base plate pivots about the second pivot point in order to keep the top sheet pressed against the feed roller.

In another embodiment of the invention, a separating claw is used to separate individual sheets of paper from the top of the stack. As the base plate moves upwardly as the sheets are removed from the stack and fed to an image forming apparatus, a cam member having a cam surface rotates due to the movement of the base plate. The separating claw which contacts the cam surface moves upwardly as the cam rotates due to the raising of the base plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 5:
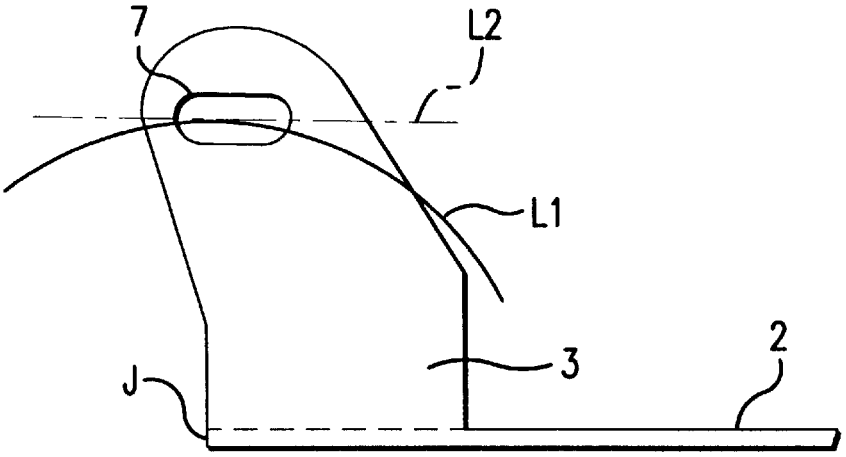
FIG. 5 illustrates the base plate and side support having an oblong hole therein utilized with a paper tray or cassette constructed in accordance with the first embodiment of the invention.

Referring now to the drawings, wherein like reference numerals designate identical or corresponding parts throughout the several views, and more particularly to FIG. 5 thereof, there is illustrated a side support 3 connected to a base plate 2 which are contained within a paper tray or cassette 1 (illustrated in FIGS. 6A and 6B), also referred to as a paper holding body. The side support 3 is mounted at an end of the base plate 2 which is opposite to a feed end of the base plate 2. The side support 3 includes an oblong hole 7 therein. The oblong hole is preferably constructed in an arcuate shape having a center thereof formed in the shape of an arc L1, or alternatively, has a center thereof formed along a straight line L2. Preferably, the arc L1 has a center at point J which is an end of the base plate which is opposite to the feed end of the base plate 2. The oblong hole 7 can have any appropriate length such as at least twice as long as the diameter of the support pin or height of the hole 7, or at least five times as long as the diameter of the support pin or height of the hole 7, for example.

Figure 6A:
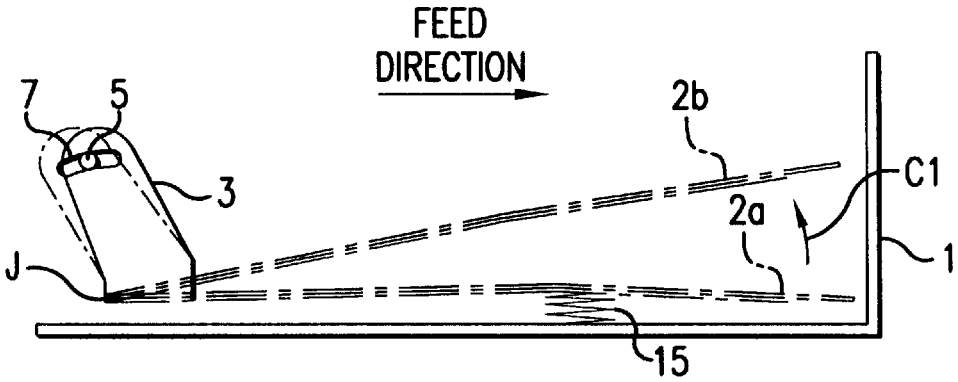
FIG. 6A illustrates the base plate being raised from a position 2*a* to a position 2*b* which pivots the base plate at a point J.
Figure 6B:
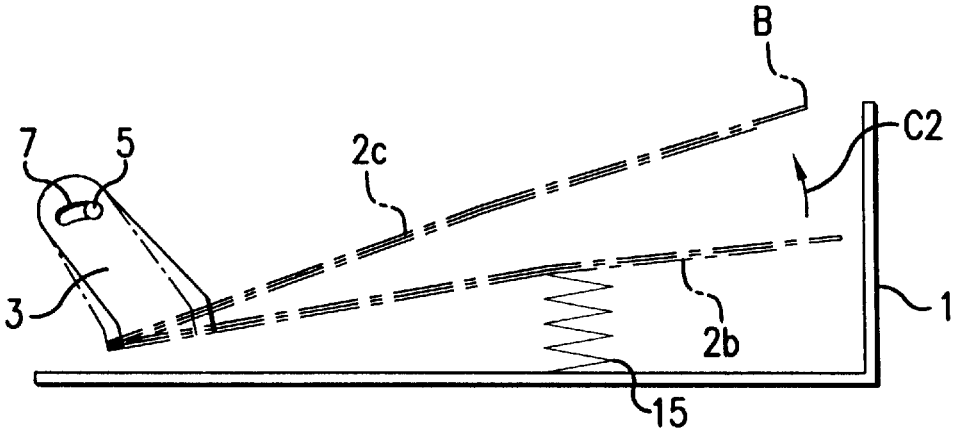
FIG. 6B illustrates the base plate being raised from a position 2*b* to a position 2*c* while the base plate pivots about the pin 5.

FIGS. 6A and 6B illustrate a pin 5 passing through the oblong hole 7. The base plate 2 is bias ed upwardly by a spring 15. In FIG. 6A, when the base plate has a full stack of sheets thereon, it is in a position 2*a,* and after an arbitrary or predetermined number of sheets are fed from off of the stack, the base plate rotates or pivots upwardly as indicated by the arrow C1 and moves to a position 2*b*. During the movement designated by C1, a first rotary or pivoting motion of the base plate 2 occurs and the base plate 2 pivots at a point J while the oblong hole 7 moves relative to the pin 5. By this pivoting motion in the counter-clockwise direction of the base plate 2, the sheets stacked on the base plate experience a very small force F (corresponding to F illustrated in FIG. 1) which forces the sheets away from the side of the tray 1. The sliding resistance F is extremely small or nonexistent in this case, thus allowing the base plate 2 with the complete stack of sheets thereon to be easily raised.

Once the pin 5 reaches the right-most end of the oblong hole 7 as illustrated in FIG. 6B, the pivoting action of the base plate 2 is now centered about the pin 5 which results in the feed end B of the base plate 2 to move closer toward the side of the paper tray 1 during at least part of the movement designated by C2. However, this does not present a problem as some or many of the sheets have already been fed from the top of the stack of sheets on the base plate 2, thus allowing the sheets to slide, if necessary. When pivoting about the pin 5, the base plate moves from the position designated by 2*b* to the position 2*c* as indicated by the arrow C2. The upward movement of the base plate is caused by a spring 15 but any desired manner or device of moving the base plate 2 can be utilized. The movement of the end of the base plate 2, designated by B, toward the side of the tray 1 prevents conventional disadvantages such as delivery of a plurality of sheets of paper, delivery of no paper, or a paper jam caused by the tip of the paper on the base plate being moved away from the side of the paper tray 1.

Figure 1:
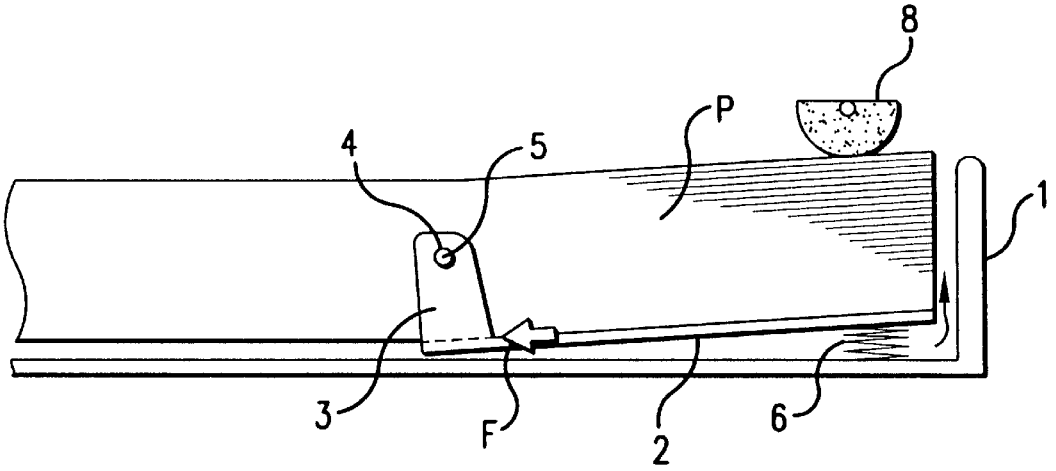
FIG.1 RELATED ART
FIG. 1 illustrates a conventional paper tray in which a base plate pivots about a pin passing through a side support.
Figure 2:
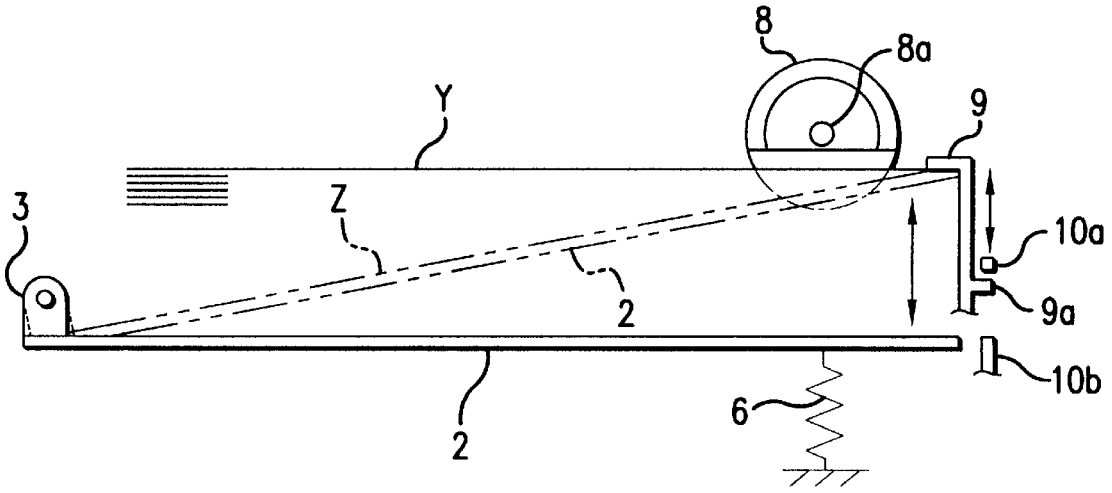
FIG.2 RELATED ART
FIG. 2 illustrates a conventional paper feeding tray in which a separation claw can move up or down.
Figure 3:
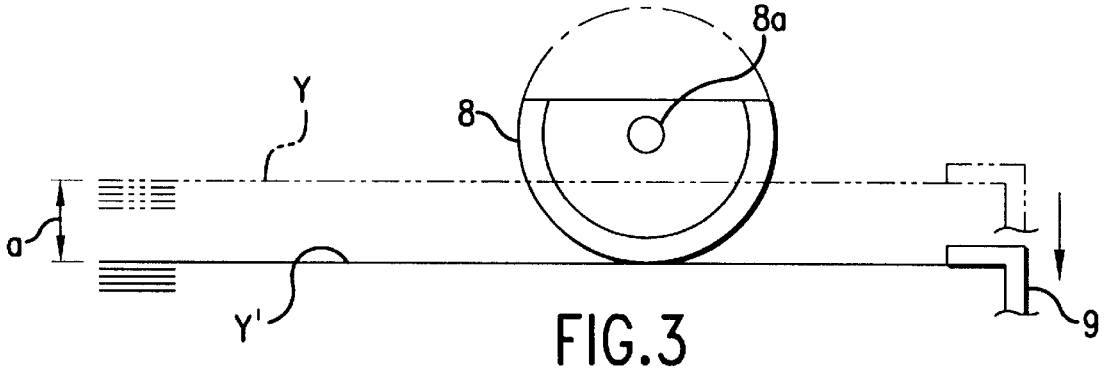
FIG.3 RELATED ART
FIG. 3 illustrates the device of FIG. 2 utilized when the paper tray is full.
Figure 4:
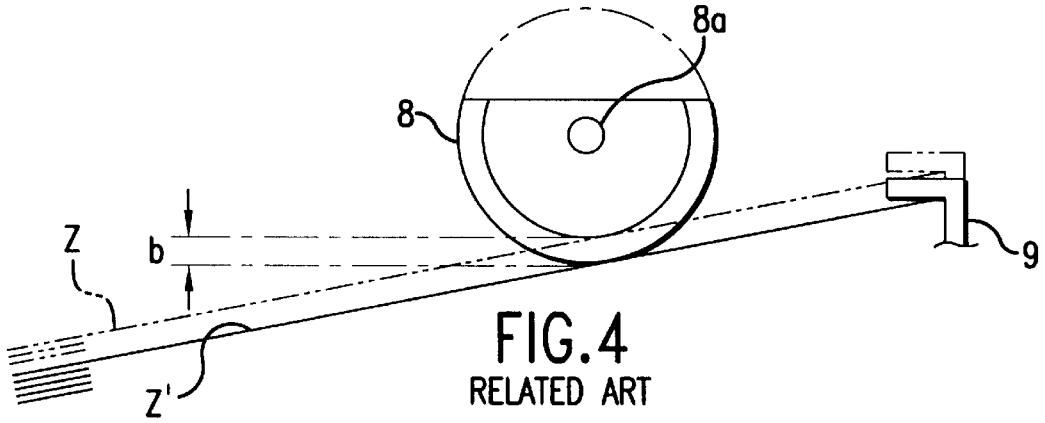
FIG.4 RELATED ART
FIG. 4 illustrates the operation of the device illustrated in FIG. 2 when the paper tray is nearly empty.
Figure 10:
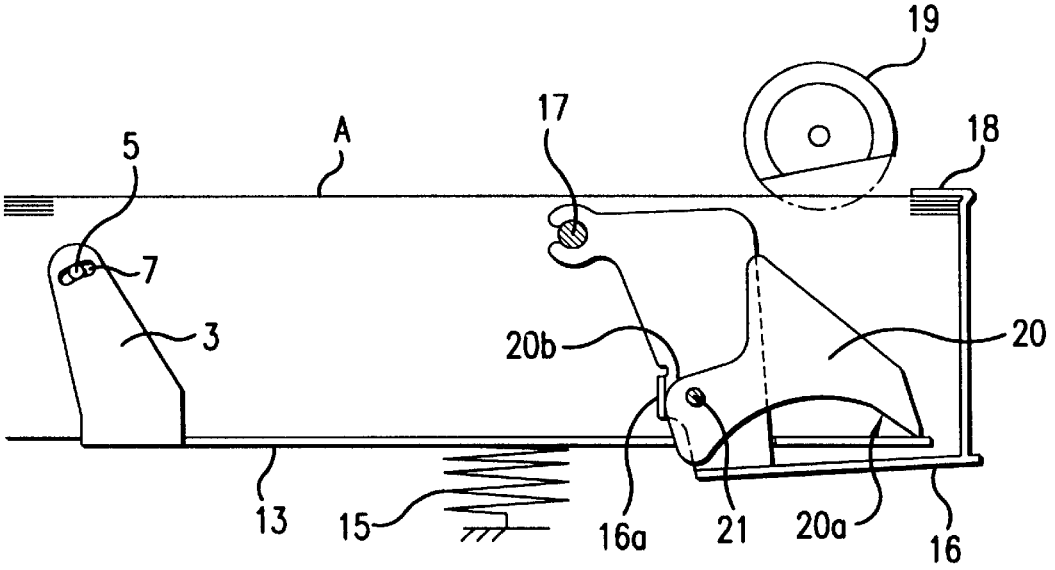
FIG. 10 illustrates a third embodiment of the invention which incorporates the features of both the first and second embodiments of the invention.

In the first embodiment, in order to feed the sheets from the top of the stack, a feed roller such as roller 19 illustrated in FIG. 10, or a feed roller 8 as illustrated in FIG. 1 is utilized.

Due to the above-described construction, the raising of the base plate occurs in two motions; a rotary motion for raising the base plate by pivoting about the point J while the oblong hole 7 moves relative to the pin 5, and a separate rotary or pivoting motion for raising the base plate 2 while having the pivot point at the pin 5 when the oblong hole 7 has an end contacting the pin 5 after a predetermined number of sheets are fed off of the base plate 2. This use of two different pivoting motions overcomes the problem of a sliding resistance preventing a fully-stacked paper tray from being properly raised and allows the base plate 2 and papers thereon to be moved closer to the end of the paper tray 1 after some of the sheets are feed. This allows the paper tray and paper feeding mechanism to handle a large number of sheets and allows the paper tray to be implemented to handle a large capacity such as 500 sheets of paper.

Figure 7A:
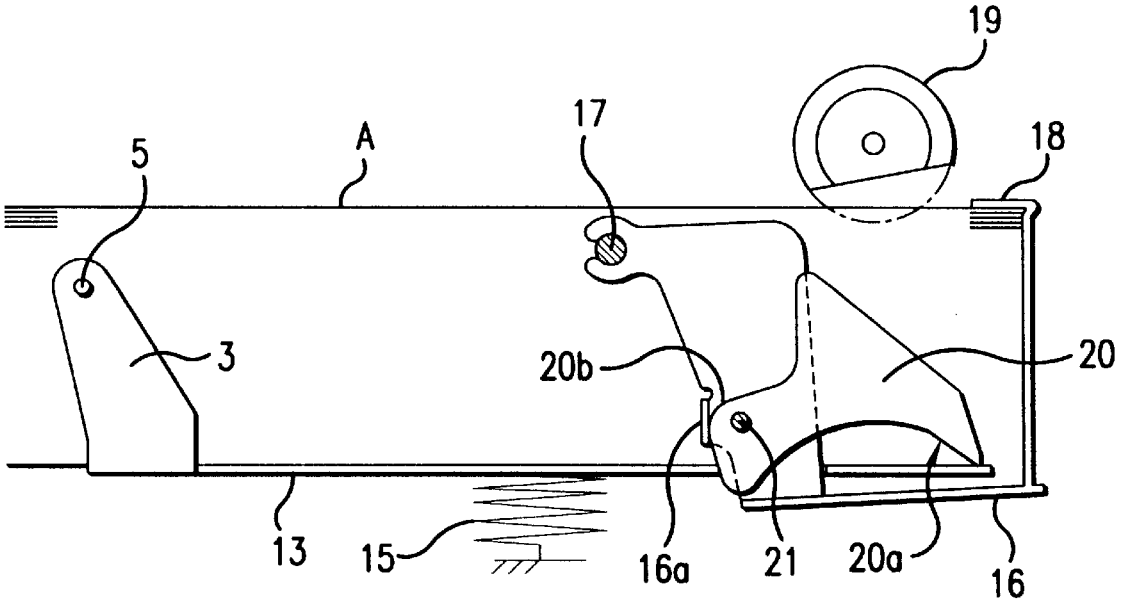
FIGS. 7A and 7B illustrate the second embodiment of the invention in which a separation claw moves depending on the position of the base plate, FIG. 7A illustrating a full condition of the paper tray and FIG. 7B illustrating a nearly empty condition of the paper tray.
Figure 7B:
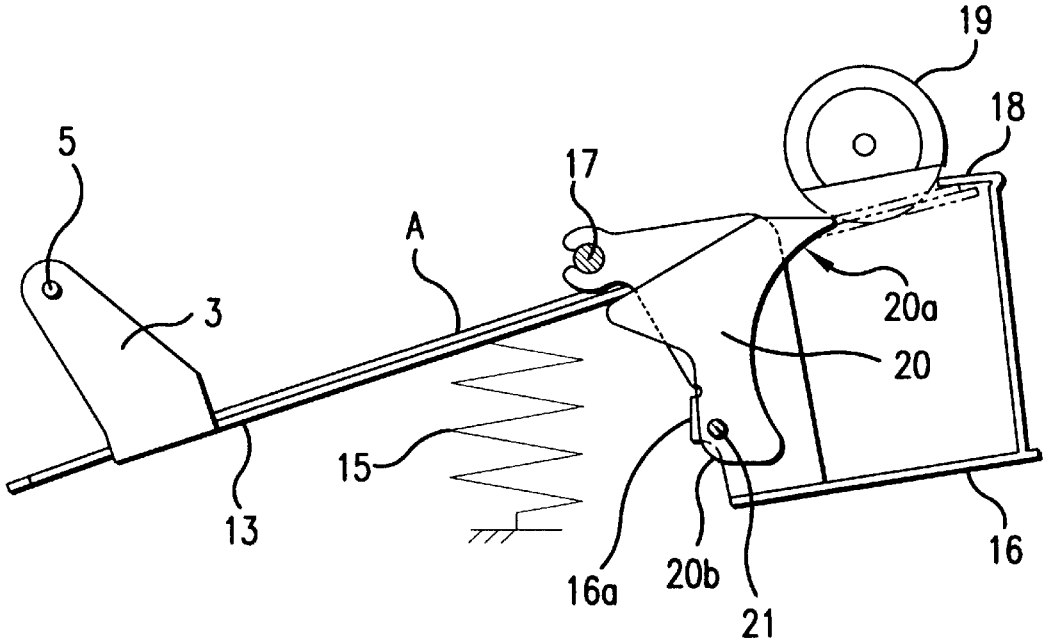
Figure 8:
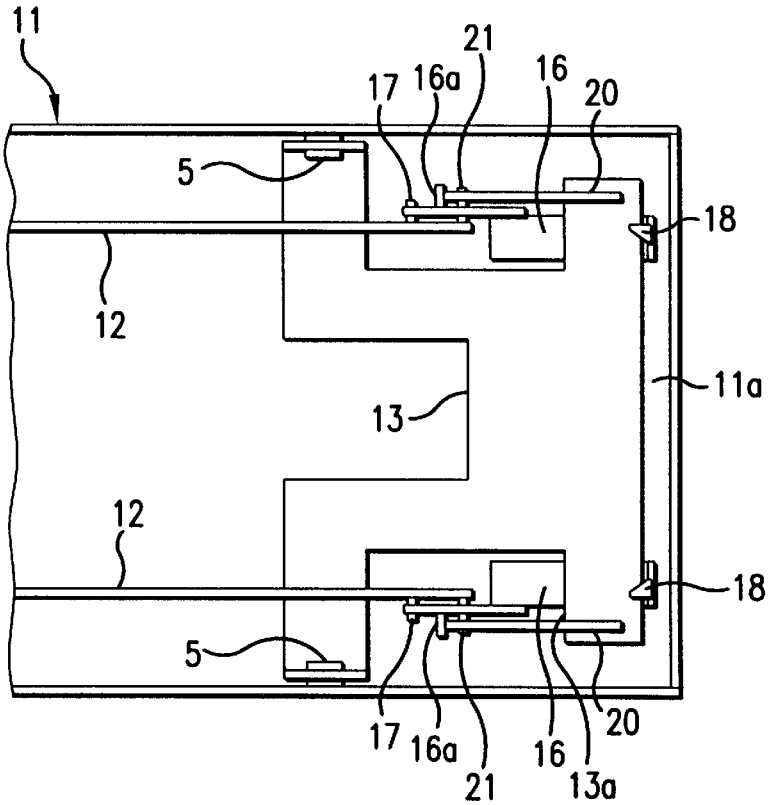
FIG. 8 illustrates a top view of the second embodiment of the invention.
Figure 11:
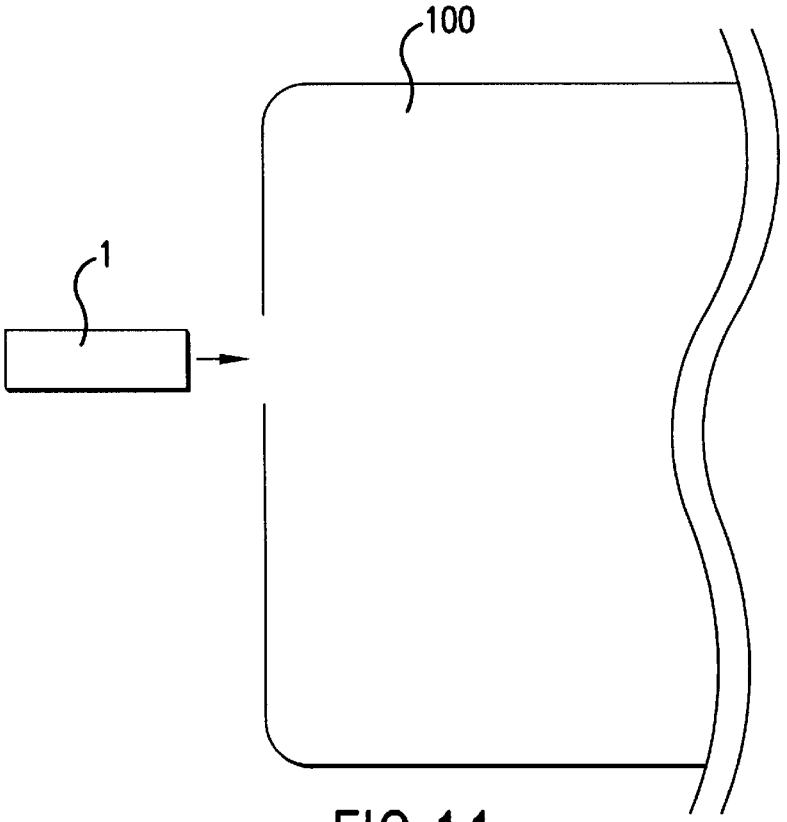
FIG. 11 illustrates an image forming device which uses the present invention.

The second embodiment of the invention is illustrated in FIGS. 7A, 7B, 8 and 9. FIG. 7A illustrates a cross-sectional view of the second embodiment with a full stack of sheets, FIG. 7B illustrates a cross-sectional view with only a few sheets remaining, and FIG. 8 illustrates a top view of the paper feeding mechanism of the second embodiment. A body 11 of the feeding mechanism includes a feed tray having a box shape with an opening in its top, as illustrated in FIG. 8 and can be implemented as a paper cassette. If the body of the device comprises a feed tray, it is installed in an image forming apparatus such as a copying machine, a printer, or a facsimile machine by its insertion into a drawer, while when implemented as a feed cassette, it is removably installed into the image forming apparatus. Side plates 12 are included in the body 11 to match the size of the sheets which are stacked therein and to surround the sheets on two sides. The body 11 has a sheet feed portion 11*a* at an upper edge of the front end and sheets are delivered one-by-one from the feed portion 11*a* toward the right in the Figures. An image forming device 100 illustrated in block diagram format in FIG. 11 receives the paper tray or cassette.

A base plate 13 is set at an inner portion of the device body 11. The base plate 13 is rotatably or pivotably connected to the device body 11 at its rear portion via a shaft 5 through a hole in a side support 3. The base plate 13 is biased upwardly due to the spring 15 illustrated in FIGS. 7A and 7B.

At the front end of the side plate 12 is a rocking member 16, more generally referred to as being part of a separating member, which freely rocks or pivots via the shaft 17, and a separation claw 18, which may be implemented as a corner separator, connected to or part of the upper portion of the front end of the rocking member or separating member 16. The separation claw 18 is positioned at the feed portion 11*a* of the device body 11 so as to hook thereunder the front edge of the top surface of a sheet contained in the body 11. The rocking member 16 is biased in a clockwise direction in FIGS. 7A and 7B due to gravity, or alternatively, due to a spring. If a spring is utilized to bias the rocking member 16 in a clockwise direction, the spring force must be smaller than the spring force transmitted by the base plate 13 against a base plate contact portion 20*a* by the spring 15. Thus, the rocking member 16 can readily rotate in the counter-clockwise direction due to the spring 15. The rocking or separating member 16 includes a stopper 16*a,* also referred to as a contact surface, protruding perpendicularly to the surface of the rocking member at which the stopper is connected. The stopper or contact surface 16*a* contacts a cam portion or cam surface 20*b* of an adjustment or cam member 20.

Sheets in the body 11 are delivered by a paper feed roller 19. The paper feed roller 19 rotates about a shaft of an image forming device which is to be utilized with the feeding mechanism. The paper feed roller 19 is half-round and generally referred to as a half-round roller. When the paper feed roller 19 rotates, its circumferential surface is brought into contact with the top sheet A in the body 11, thus delivering the top sheet A from the feed portion 11*a*. Although a position at which the paper feed roller 19 is brought into contact with the top sheet A can be arbitrarily set, it is generally preferable that the paper feed roller contacts the top sheet A slightly rearward of the feed portion 11*a*.

At the front end of the side plate 12, there is the adjustment or cam member 12 connected via a shaft 20 which can rotate, independent of the rocking or separating member. The adjustment or cam member 20 is outside of the side plate 12, which prevents the cam member 20 from being a barrier when sheets are contained within the side plates 12. The adjustment or cam member 20 has a base plate contact portion 20*a* which contacts the base plate 13, and a cam portion or cam surface which contacts the stopper or contact surface 16*a*.

Figure 9:
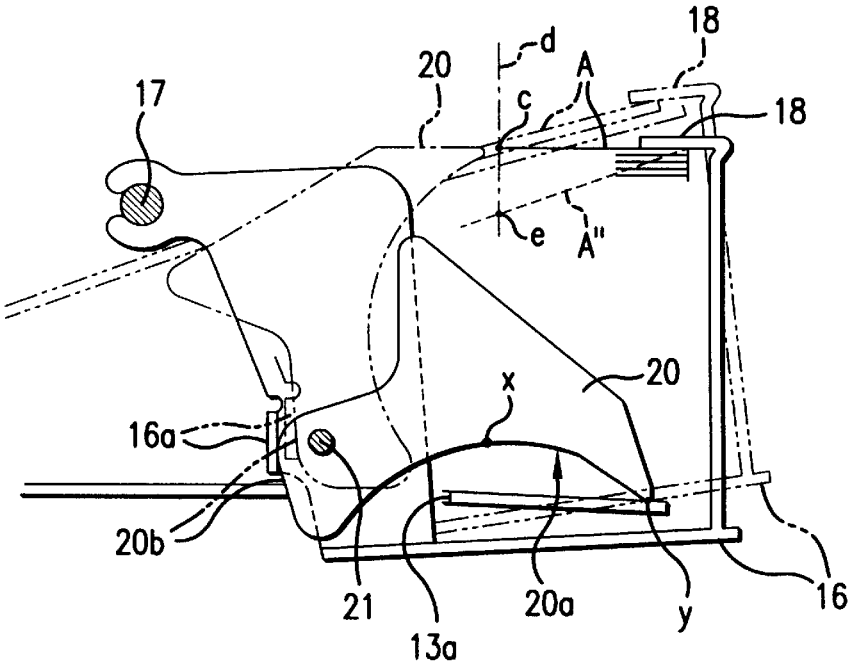
FIG. 9 illustrates the operation of the second embodiment of the invention.

FIG. 9 is an enlarged side view of the rocking or separating member 16, the adjustment or cam member 20, and the other parts of the mechanism which is used to control the height or position of the separating claw 18. As shown in FIG. 9, the base plate contact portion 20*a* of the adjustment member 20 always contacts the upper surface of the base plate 13 due to gravity or a spring. When the adjustment member 20 has the shape as illustrated in the drawings, the base plate contact portion 20*a* corresponds to a region from a tip y protruding in the form of a claw to a middle point x. Depending on a position of the base plate, different points along the surface between x and y contact the base plate 13. In other words, as the base plate 13 pivots from the lower position indicated by a solid line to the higher position indicated by a dotted line in FIG. 9, the base plate contact portion 20*a* is brought into contact with an end 13*a* of a middle portion of the base plate. In this manner, the adjustment member 20 in contact with the base plate 13 rotates about the shaft 21 and is therefore linked with a rotary motion of the base plate 13.

On the other hand, the cam surface 20*b* of the adjustment member 20 is brought into contact with a stopper or contact surface 16*a* of the rocking or separating member 16 to restrain rocking in the counter-clockwise direction of the rocking member. The form of the cam surface 20*b* is appropriately designed so that the rocking member 16 can be held at a desired rocking position so as to meet the rotary position of the base plate 13. The cam surface 20*b* is formed so that as the base plate 13 rotates from the lower position indicated by the solid line to the higher position indicated by the dashed line, the rocking member 16 begins to pivot gradually in the counter-clockwise direction so as to raise the separation claw 18.

More particularly, the cam surface 20*b* is formed so that a part C of FIG. 9 of the upper surface of the top sheet to be brought into contact with the paper feed roller 19 maintains almost a fixed height without being in contact with the paper feed roller 19, even if the base plate 13 pivots.

During operation of the feeding mechanism of the second embodiment, initially, a plurality of sheets are contained in the body 11 and stacked on the base plate 13. The top sheet of the stacked sheets is hooked under the separation claw at its upper edge of the front end. When a plurality of sheets are stacked and the paper tray is full, the base plate 13 is placed at a lower position, as shown in FIG. 7A and as indicated by the solid line in FIG. 9. As for the adjustment member 20, the base plate contact portion 20*a* is in contact with the base plate 13 and the cam surface 20*b* contacts the contact surface 16*a* of the separating member 16. The adjustment member 20 restrains the rocking position of the separating member 16 so that the separation claw 18 maintains a fixed height.

If the paper feed roller 19 is driven to rotate to start the feed operation when in the above condition, a circumferential surface of the paper feed roller 19 is brought into contact with the top sheet A which lowers the sheets downward and then pushes the top sheet A in a forward direction. Since the top sheet A is hooked under the separation claw 18 at its front end, the sheet is curved between the paper feed roller 19 and the separation claw 18. The top sheet A then is pulled from under the separation claw 18 thus feeding in a forward direction a single top sheet A. The sheet under the top sheet is also pushed forward by a friction with the top sheet A and may also become curved. When a repulsion caused by the curving becomes greater than the friction with the top sheet, the second sheet slides to return to its original sheet and is therefore not delivered with the top sheet.

When the feed operation of the top sheet A is repeated, the base plate 13 pivots a small amount in the counterclockwise direction with the feeding of each sheet. The pivoting or rotary motion of the base plate 13 causes the adjustment member to move rotatably in the counter-clockwise direction and the place where the cam surface 20*b* contacts the contact surface 16*a* changes. The changing cam surface thus causes the position of the rocking or separating member 16 to rotate in the counter-clockwise direction and therefore causes the separation claw 18 to ascend little-by-little.

In FIG. 9, the solid line designates a state in which a large number of sheets are stacked on the base plate 13 and corresponds to FIG. 7A, and the dashed line designates that only a few sheets remain on the base plate 13 and corresponds to the state illustrated in FIG. 7B. The dashed line d illustrated in FIG. 9 is a straight line extending vertically downward from the center of the paper feed roller 19, and at an intersection point c, and e which designate the contact points of the feed roller 19 the paper feed roller 19 is brought into contact with the top sheet. As seen from FIG. 9, the intersection points c and e are identical in respective states and hence a certain amount is always obtained as an amount of lowering the sheets and the base plate 13 by the pressured contact with the paper feed roller 19.

Accordingly, the paper feed roller 19 presses the top sheet A so as to lower the top sheet to a point slightly downward from the intersection point c, independent of the amount of the stacked sheets in the feed operation. As a result, a load on the shaft of the roller can be reduced and a radius of the roller can be reduced.

For purposes of the following explanation, assume that the separation claw 18 is fixed and cannot ascend as described above. This fixing of the separation claw 18 will result in the top sheet being placed in the position indicated by the dashed line A only when a few sheets remain on the base plate 13. An intersection point e of the top sheet at this position and the line designated by d (in other words, a position in which the paper feed roller 19 is brought into contact with the top sheet) becomes lower than the above intersection point c as shown in FIG. 9. Accordingly, when a plurality of sheets are stacked on the base plate 13, as indicated by the state designated by the solid line in FIG. 9, the top sheet A must be lowered to a further downward position from the intersection point e in the feed direction and therefore causes a problem that the amount the top sheet and base plate must be lowered is significantly increased. With the present invention, as the separation claw 18 moves as described above, this problem is overcome.

The second embodiment of the invention is not strictly limited to the illustrations of FIG. 7A to FIG. 9. For example, the adjustment member is not limited to the shape illustrated in the drawings but can be appropriately designed so that the rocking member is supported in a desired rocking position so as to meet the rotary position of the base plate. Additionally, this embodiment and the other embodiments can be applied to different types of sheet processing units requiring a stack of sheet paper and the feeding of the sheets of paper one-by-one.

Another embodiment of the invention is illustrated in FIG. 10. This embodiment is a combination of the first and second embodiments. In FIG. 10, the side support 3 contains an oblong hole similar to that illustrated in the embodiments of FIGS. 5, 6A, and 6B. Further, the embodiment of FIG. 10 includes the adjustment member, rocking member, and separating claw and the other components of the second embodiment illustrated in FIGS. 7A–9.

The present invention also includes an image forming apparatus such as a printer, copier, facsimile machine, etc. such as the image forming apparatus disclosed in U.S. Pat. No. 5,508,810, which is incorporated herein by reference, implemented to utilize the paper feeding techniques and components described herein.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patents of the United States is:

1. A device for feeding papers, comprising:

a paper holding body including:

a base plate which supports sheets, the base plate having a feed end from which sheets are fed;

a side support, connected to the base plate, having an oblong hole therein; and a support pin passing though the oblong hole, a device configured to urge the base plate upwardly from the paper holding body so that a structural arrangement of the paper holding body and the device configured to urge causes the base plate to have a first pivot point and pivot about the first pivot point, when the end of the base plate from which the sheets are fed is lower than a first predetermined level, and causes the base plate to have a second pivot point and pivot about the second pivot point, different from the first pivot point, which is located at a position of the support pin, when the end from which the sheets are fed is higher than a second level.

2. A device according to claim 1, wherein:

the first pivot point is an end of the base plate opposite to the feed end.

3. A device according to claim 1, wherein:

the base plate has the first pivot point from when the base plate is in a horizontal-most position until the base plate is pivoted to a first predetermined angle relative to a bottom of the paper holding body; and the base plate has the second pivot point when the base plate is at an angle relative to the bottom of the paper holding body which is a largest angle at which paper is fed.

4. A device according to claim 1, wherein the oblong hole is at least twice as long as a diameter of the support pin.

5. A device according to claim 1, wherein the oblong hole is at least five times as long as a diameter of the support pin.

6. A device according to claim 1, further comprising:

an image forming apparatus to which the sheets are fed.

7. A device according to claim 1, further comprising:

a roller which feeds the sheets off of a top of the stack of sheets.

8. A device according to claim 1, further comprising:

a cam member, including a cam surface, which rotates as the base plate moves and as the sheets are fed off of the base plate; and a movable separating member, contacting the cam surface, which is raised as the cam member rotates as the sheets are fed off of the base plate.

9. A device according to claim 1, wherein:

the oblong hole has an arc shape.

10. A device according to claim 1, wherein:

the oblong hole has an arc shape which is centered at end of the base plate which is opposite to the feed end of the base plate.

11. A device according to claim 1, further comprising:

means for changing a point at which the base plate pivots from the first pivot point to the second pivot point.

12. A device for feeding papers according to claim 1, wherein:

the device configured to urge comprises a spring disposed between the base plate and a lower portion of the paper holding body.

13. A method of feeding sheets from a stack of sheets of a paper holding body, comprising the steps of:

removing one of said sheets from the stack of sheets on a base plate which has a first pivot point;

pivoting the base plate at the first pivot point as some of the sheets of the stack including said one of said sheets are removed from the stack by an urging force from a device configured to pivot the base plate;

changing the pivot point of the base plate to a second pivot point which is different from the first pivot point, by pivoting the base plate by the urging force from the device configured to pivot the base plate;

removing another of said sheets from the stack of sheets on the base plate which has, the second pivot point; and pivoting the base plate at the second pivot point as others of the sheets of the stack including said another of said sheets are removed from the stack by the urging force from the device configured to urge.

14. A method according to claim 13, wherein the step of pivoting the base plate at the first pivot point comprises:

pivoting the base plate at the first pivot point which is an end of the base plate opposite to a feed end.

15. A method according to claim 14, wherein the step of pivoting the base plate at the second pivot point comprises:

pivoting the base plate about a support pin which passes through an oblong hole in a side support connected to the base plate.

16. A method according to claim 13, wherein the step of pivoting the base plate at the second pivot point comprises:

pivoting the base plate about a support pin which passes through an oblong hole in a side support connected to the base plate.

17. A method according to claim 13, wherein the step of changing the pivot point comprises:

changing the pivot point due to a raising of the feed end as paper is fed off of the stack.

18. A method according to claim 13, wherein:

the urging force is generated by the device configured to pivot the base plate which is a spring between the base plate and a lower portion of the paper holding body.

19. A paper feeding mechanism, comprising:

a movable base plate;

a cam member, including a cam surface, which rotates as the base plate moves and as sheets are fed off of the base plate; and a movable separating member, connected to a cam follower which contacts the cam surface, which is raised as the cam member rotates due to relative movement between the cam follower and cam surface as the sheets are fed off of the base plate.

20. A paper feeding mechanism according to claim 19, wherein the cam member further comprises:

a base plate contact portion which contacts the base plate and causes the cam member to rotate as the base plate moves.

21. A paper feeding mechanism according to claim 19, wherein:

the movable separating member is pivotally mounted and includes a contact surface which contacts the cam surface.

22. A paper feeding mechanism according to claim 19, wherein:

the movable base plate is pivotally mounted at an end opposite to a feed end.

23. A paper feeding mechanism according to claim 19, further comprising:

a side support, connected to the base plate, having an oblong hole therein; and a support pin passing though the oblong hole, wherein when the end of the base plate from which the sheets are fed is lower than a first predetermined level, the base plate has a first pivot point, and when the end from which the sheets are fed is higher than a second level, the base plate has a second pivot point, different from the first pivot point, which is located at a position of the support pin.

24. A paper feeding mechanism according to claim 19, further comprising:

an image forming apparatus to which the sheets are fed.

25. A method for adjusting a position of a separating member based on a thickness of a stack of sheets on a base plate, comprising the steps of:

detecting a position of the base plate; and adjusting a height of the separating member based on the position of the base plate which was detected, wherein:

the detecting step comprises detecting the position of the base plate by contacting a cam member with the base plate, a rotational position of the cam member indicating a position of the base plate; and the adjusting step comprising adjusting the height of separating member based on the rotational position of a cam surface of the cam member relative to a cam follower connected to the separating member.

* * * * *